US007014291B2

(12) United States Patent
Ishikawa

(10) Patent No.: US 7,014,291 B2
(45) Date of Patent: Mar. 21, 2006

(54) INK JET RECORDING APPARATUS

(75) Inventor: Tetsuya Ishikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/354,005

(22) Filed: Jan. 30, 2003

(65) Prior Publication Data

US 2003/0156153 A1 Aug. 21, 2003

(30) Foreign Application Priority Data

Feb. 15, 2002 (JP) ..... 2002-038905

(51) Int. Cl.
*B41J 2/165* (2006.01)

(52) U.S. Cl. ..... 347/29; 347/30; 347/32; 347/33

(58) Field of Classification Search ..... 347/22–35, 347/37; 400/55, 59
See application file for complete search history.

(56) References Cited

U.S. PATENT DOCUMENTS 5,153,613 A 10/1992 Yamaguchi et al. ..... 347/30
5,670,997 A * 9/1997 Sugimoto et al. ..... 347/30
5,903,287 A 5/1999 Ishikawa et al. ..... 347/24
6,010,203 A * 1/2000 Muraki ..... 347/30
6,062,670 A 5/2000 Iwata et al. ..... 347/23
6,203,136 B1 * 3/2001 Takahashi et al. ..... 347/32
6,260,943 B1 7/2001 Ishikawa ..... 347/32
6,511,153 B1 1/2003 Ishikawa ..... 347/35
6,578,948 B1 * 6/2003 Shima ..... 347/29

FOREIGN PATENT DOCUMENTS

JP 3-93548 4/1991

* cited by examiner

*Primary Examiner*—Shih-Wen Hsieh
(74) *Attorney, Agent, or Firm*—Fitzpatrick, Cella, Harper & Scinto

(57) ABSTRACT

An ink jet recording apparatus, which records by discharging ink from a recording head includes a cap for covering a discharge port surface of the recording head; a suction unit for effecting suction of ink from the discharge ports; and ink flow paths connecting a suction port of the cap to the suction unit. After effecting suction of ink from the discharge ports by the suction unit, the side of the cap opposite to the side where the suction port is arranged is parted, and when the cap and the recording head are set apart, the cap is positioned horizontally or in a posture having the side of the suction port arranged therefor made lower than horizontal. With the structure thus arranged, ink remaining in the cap can be suctioned and removed efficiently when the cap is parted and idle suction is performed inside the cap after the suction recovery process or the like for the maintenance of stable ink discharge performance at all times.

6 Claims, 10 Drawing Sheets

INK JET RECORDING APPARATUS

BACKGROUND OF THE INVENTION

1. Field of the Invention

The present invention relates to an ink jet recording apparatus that records by discharging ink from recording means to a recording material.

2. Related Background Art

A recording apparatus that is provided with the function of a printer, a copying machine, a facsimile machine, or the like, or a recording apparatus that is used as output equipment for complex electronic equipment, a work station, or the like, that includes a computer or a word processor, among other recording apparatuses, is structured to record images (including characters, symbols, or the like) on a recording material (recording medium) such as paper, cloth, a plastic sheet, or an OHP sheet in accordance with image information (recording information). The recording apparatuses are classified into ink jet type, wire-dot type, thermal type, and laser beam type, among some other types, depending on the adopted recording method.

The serial type recording apparatus, which records while performing main scans in a direction intersecting with the conveying direction of a recording material, forms images by discharging ink from a recording head serving as recording means, while it moves (performs main scans) along the recording material, and a sheet feeding of a predetermined amount (pitch conveyance serving as a sub-scanning) is effected subsequent to the completion of image formation of one line portion. Then, the recording (main scanning) of the images of the next portion is performed on the recording material, which is made stationary again. Such operation is repeated to complete the entire recording on the recording material. On the other hand, in the line type recording apparatus, which records only by sub-scanning in the conveying direction of a recording material, the recording material is set at a predetermined recording position, and then, after the recording of one line portion is executed altogether, the sheet feeding of a predetermined amount is effectuated, and the recording of the next line is performed altogether, and by repeating such operation, the recording is made on the recording material entirely.

Among these types of recording apparatuses, the ink jet type recording apparatus (ink jet recording apparatus) performs recording by discharging ink from an ink discharge portion thereof to a recording material, which makes it easier to arrange the recording head compactly for the recording of highly precise images at high speed. Also, there are advantages, among many other advantages, that the recording can be effected on plain paper without special treatment and thus the running cost of the apparatus is made lower, and that, being of non-impact type, the apparatus makes less noise, and, further, color images can be formed with ease by using many kinds of ink (various colors of ink, for example).

For the ink jet recording apparatus that records by discharging ink from the discharge ports formed in recording means to a recording material, there is provided discharge port protection means or discharge recovery process means in order to eliminate clogging of the discharge ports due to dried ink or ink discharge defects due to dust particles, bubbles, or the like in the discharge ports.

The main structure of the discharge port protection means is capping means, which covers a discharge port surface of the recording head serving as recording means by use of a cap formed by elastic material, such as rubber. Also, the main structure of the discharge recovery process means is suction recovery means for removing the causes of ink discharge defects, together with ink, from the inside of the cap by means of the suction or pressure reduction by negative pressure generating means, such as a pump, to forcibly discharge ink from the discharge ports; pre-discharge means that discharges ink from the discharge ports for a purpose other than recording; and wiping means that removes ink and other adhering matter from the discharge port surface, among some other components.

Also, for the negative pressure generating means (suction means) that reduces the inner pressure of the cap, a piston pump, a tube pump, or the like is used. Also, as suction means for removing ink residing in the cap or in the ink flow path formed by a tube or the like after suction, there are mainly two means. A first means is the "cap-open idle suction", which performs suction while keeping the cap apart from the recording head. For example, cap-open suction means has been proposed in Japanese Patent Application Laid-Open No. 03-093548, in which a cap is released, while being inclined, without any provision of a valve mechanism for atmospheric communication. A second means is the "cap closed idle suction", which performs suction after the inside of the cap is made to be communicative with the atmosphere by use of the atmosphere communication mechanism provided with a valve capable of keeping the inside of the cap communicative with the atmosphere in a state of being capped. The atmosphere communication mechanism in this case is, in general, structured by a tube communicating with the inside of the cap, and the atmosphere communication valve arranged at the leading end of the tube, which is made freely open or closed. The cap closed idle suction is disclosed in U.S. Pat. No. 5,153,613, for example. Such suction is capable of effecting more reduction of ink remains than the cap-open idle suction.

The cap-open idle suction makes it easier to provide the suction mechanism smaller at lower costs, but has drawbacks, such as ink in the cap may drip into the recording apparatus, because the cap is almost in the horizontal posture when it is open to discharge ink substantially in the horizontal direction, for example.

Moreover, along with the enhancement of image quality that has been increasing in demand, the precision of ink discharge position becomes more important in recent years, and thus, in terms of the discharge stabilization, the discharge ports of a recording head tend to be installed almost horizontally to enable ink to be discharged downward vertically. Such a mechanism is now considered to be common. In such a mechanism, if a cap is released diagonally from the opposite side of the suction port provided thereon in order to induce the air into the cap, the suction port of the cap is positioned on the upper side of the cap thus inclined (on the side higher in the vertical direction). As a result, a drawback is encountered such as to make it difficult to suck ink from the inside of the cap by a pump for the sufficient removal of ink.

Particularly, in a case of pigment ink, if the cap absorbent formed by a material having large pore diameters is used for the prevention of clogging, the propagating speed of pigment ink in the ink absorbent is made slower (the ink propagation becomes difficult). As a result, if the posture of the cap is arranged so as to position the suction port to be on the lower side of the inclination as described earlier, a drawback that the capability of ink collection is made extremely low may be encountered.

Then, if ink is not removed from inside the cap sufficiently, ink is caused to adhere to the discharge port surface in the succeeding operations, such as the next opening or closing of the cap. Consequently, the ink that has adhered is transferred to the carrier systems or ink spreads greatly when being wiped. Further, ink adheres to the blade, which is accumulated thereon in a short period of time, and brings about a drawback that the wiping performance is made lower, among some other drawbacks.

On the other hand, when using such an atmosphere communication mechanism as the cap closed idle suction, the performance of ink removal capability is high. But, it is unavoidable that not only the cost of the suction means is higher, but also, the size thereof becomes greater. Moreover, when the atmosphere communication mechanism is used, the inside of the atmosphere communication tube is made a negatively pressurized chamber if the suction operation is performed in a state where the atmosphere communication valve is closed. As a result, ink forcibly discharged from the recording head enters the interior of the atmosphere communication mechanism, and the ink thus entered is dried unless the entered ink in the atmosphere communication mechanism is discharged exactly by the idle suction that follows immediately thereafter. Thus, a drawback is encountered such as eventual clogging of the atmosphere communication port in some cases.

SUMMARY OF THE INVENTION

It is an object of the present invention to provide an ink jet recording apparatus capable of minimizing the amount of ink remaining in the cap, on the discharge port surface of recording means and the like, and maintaining stable ink discharge performance at all times, by efficiently sucking and removing ink remaining in the cap and other matter when the cap is positioned apart and the idle suction is performed inside the cap immediately after the suction recovery process or the like.

It is another object of the invention to provide an ink jet recording apparatus for recording by discharging ink from recording means, which comprises: a cap for covering a discharge port surface of the recording means; suction means for sucking ink from discharge ports; and ink flow paths connecting a suction port arranged for the cap to the suction means, wherein after sucking ink from the discharge ports by the suction means, the side of the cap opposite to the side where the suction port is arranged is parted, and when the cap and the recording means are set apart, the cap is horizontally postured or in a posture having the side of the suction port arranged therefor made lower than horizontal.

BRIEF DESCRIPTION OF THE DRAWINGS

FIG. 4A shows the condition under which the cap is open during the recording operation or the like; FIG. 4B shows the capping condition at the time of executing a suction recovery process or the like; and FIG. 4C shows the condition under which the side opposite to a suction port of the cap is made apart from a discharge port surface, while enabling the cap to be inclined when the idle suction or the like is executed.

DETAILED DESCRIPTION OF THE PREFERRED EMBODIMENTS

Figure 1:
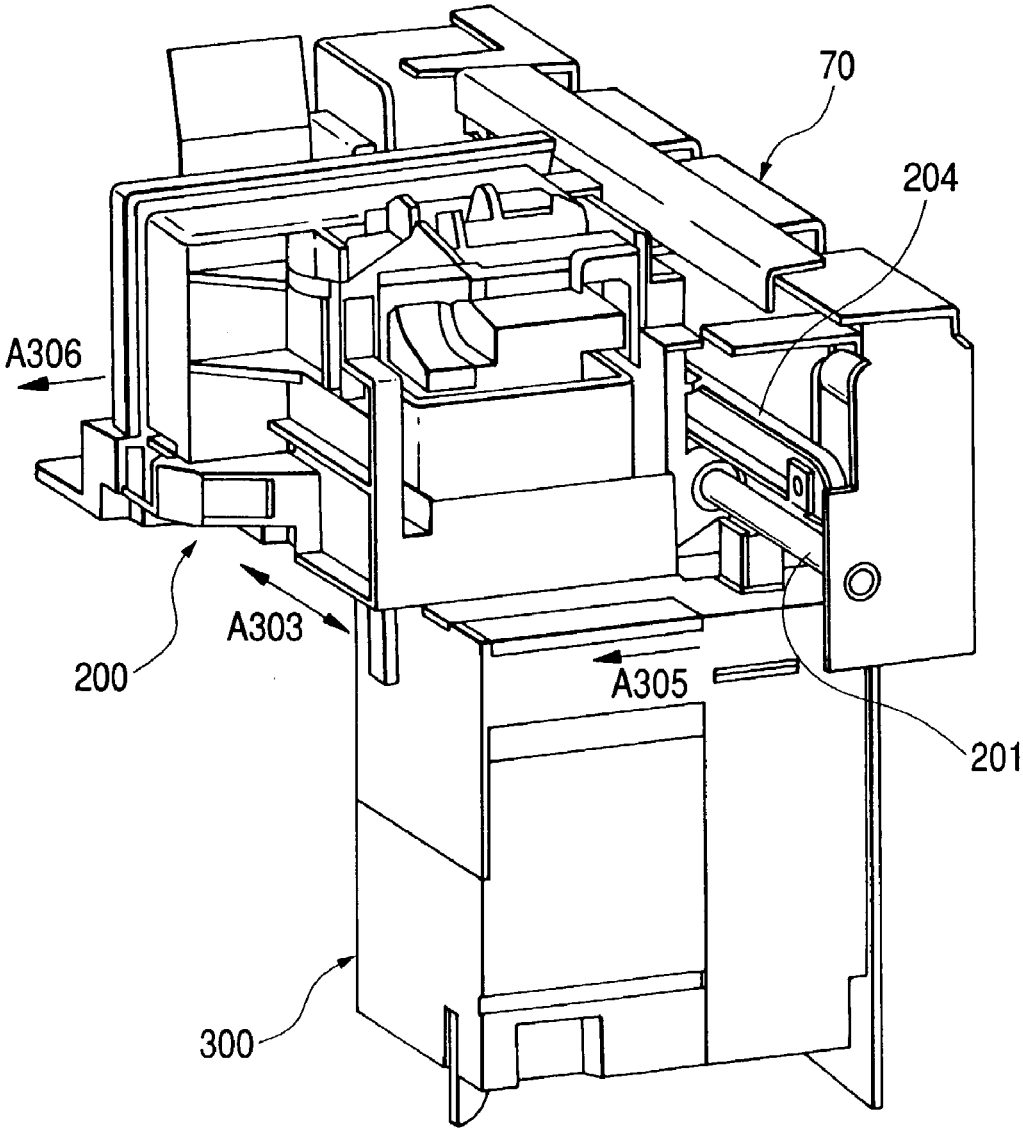
FIG. 1 is a perspective view that shows the external appearance of an engine unit (a portion that performs the recording operation) of an ink jet recording apparatus to which the present invention is applicable.

Hereinafter, with reference of the accompanying drawings, the description will be made of the embodiments specifically in accordance with the present invention. In this respect, the same reference numerals designate the same or corresponding parts throughout each of the accompanying drawings.

First Embodiment

FIG. 1 is a perspective view that shows the external appearance of an engine unit (the portion that performs the recording operation) of an ink jet recording apparatus to which the present invention is applicable. In FIG. 1, the ink jet recording apparatus is provided with a recording head 100 (see FIG. 3 and FIGS. 4A to 4C) that serves as recording means for recording by discharging ink, and a carriage unit 200 having the recording head 100 mounted thereon, which is movable in the direction indicated by a double head arrow A303, and guided and supported by a guide shaft 201 through a timing belt 204 driven by a carriage motor (not shown).

In other words, the carriage unit 200 that mounts the recording head 100 is structured to be movable along the guide shaft 201 in the directions indicated by the arrow A303 across the left and right sides (the depth side and the front side in FIG. 1) of the recording position and the stand-by position at the central portion. In this respect, an arrow A305 indicates the conveying direction of a recording sheet on one side, and an arrow A306 indicates the conveying direction of the recording sheet on the opposite side (the other side).

The ink jet recording apparatus is further provided with an ink supply unit (not shown) for supplying ink to the recording head 100; a recovery unit 300 for maintaining and recovering the ink discharge characteristics of the recording head 100; and a frame unit 70 for fixing the guide shaft 201, and also, for housing and fixing the recovery unit 300.

Here, the lower side face (downward surface) of the recording head 100 (see FIG. 3 and FIGS. 4A to 4C) is made to be a discharge port surface formed with plural discharge ports in a predetermined arrangement. The discharge port surface is inclined at an angle of approximately 5 degrees to the horizontal plane.

The recording head 100 utilizes thermal energy for discharging ink, and is provided with an electrothermal converting element that generates thermal energy. Also, the recording head 100 discharges ink from the discharge ports for the formation of images by the utilization of pressure changes generated by the growth and shrinkage of bubbles by means of film boiling generated by the thermal energy applied by the electrothermal converting element.

Figure 13:
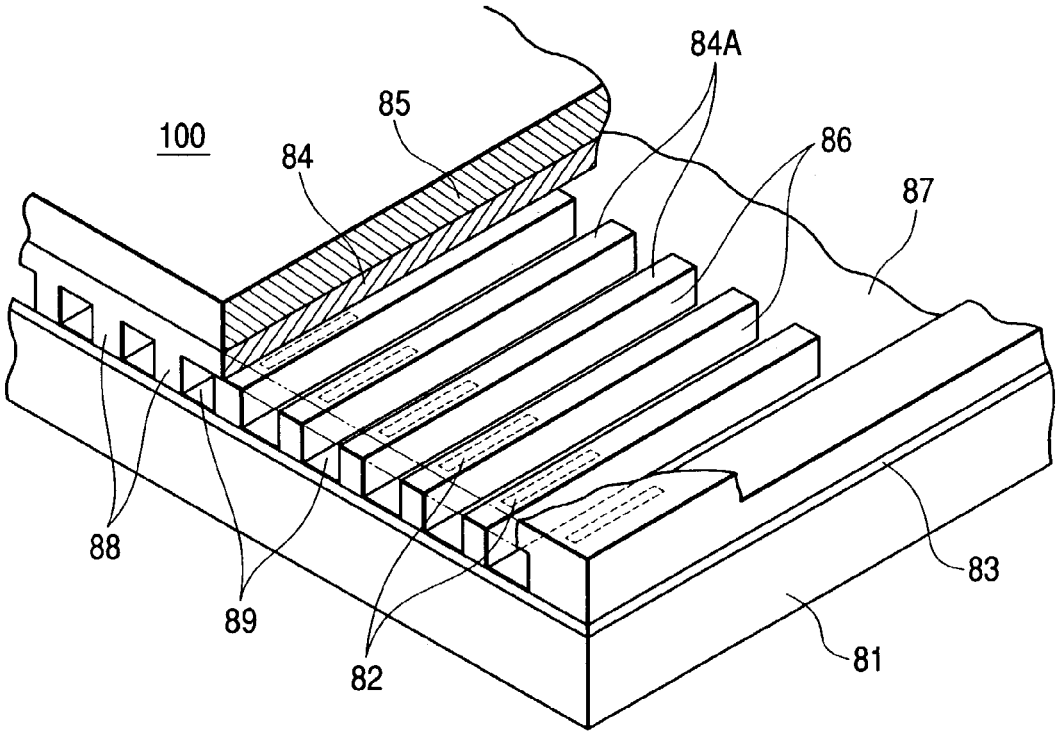
FIG. 13 is a partial perspective view that schematically shows the structure of the ink discharge portion of recording means of the ink jet recording apparatus represented in FIG. 1.

FIG. 13 is a partial perspective view that schematically shows the structure of the ink discharge portion of recording means of the ink jet recording apparatus 100. In FIG. 13, there are formed, on a base plate 81 of the recording head 100, plural electrothermal converting elements 82 and wires corresponding thereto by the same manufacturing processes as those used for semiconductor formation (such as a method for forming thin film) through a thin film layer 83. Each of the electro-thermal converting elements 82 is arranged on a position corresponding to each discharge port 89 and liquid flow path 86 as shown in FIG. 13. Then, a flow path formation member 84, which is provided with plural flow path walls 84A formed in parallel on the lower face thereof at predetermined intervals, is bonded to the base plate 81 (to the thin film layer 83 on the base plate 81), and further, a ceiling plate 85 is bonded to the upper face of the flow path formation member 84. Here, on the base plate 81, the electric wiring, which contains the electrothermal converting element 82, the flow path formation member 84, and others are bonded. Thus, a discharge element base plate is structured.

The flow path 86 is formed between each of flow path walls 84A. Here, the flow path formation member 84 is positioned and bonded to the base plate 81 (to the thin film layer 83 on the base plate 81) in such a positional relation that each of the aforesaid electrothermal converting elements 82 is arranged on the designated inner position of each of the flow paths 86. Each flow path wall 84A has a predetermined length, and the rear end of each flow path 86 is communicated with a common liquid chamber 87, which is formed between the flow path formation member 84 and the base plate 81 (or the thin film 83). On the other hand, the other end (the front end) of each flow path 86 is open to a discharge port surface (the surface having the specifically arranged discharge ports 89 formed thereon) 88 of the recording head 100, thus forming the discharge port 89 with each of such opening portions.

In this manner, each electrothermal converting element 82, such as a heat generating resistive member, is energized (with the application of a pulse voltage) to enable it to generate heat. The recording head 100 of the ink jet type is thus structured to generate film boiling in ink in the flow path 86, and discharge ink droplets from the discharge port 89 with the pressure changes exerted at that time. The recording head 100 is installed in such a posture that the arrangement direction of the plural discharge ports 89 intersect with (are substantially orthogonal to) the conveying directions A305 and A306 of the recording material, and then, the distance between the discharge port surface 88 and the recording material (that is, a clearance to a paper sheet) is selected to be approximately 0.3 mm to 2.0 mm.

If dust particles should adhere to the discharge port surface of the recording head 100 or to the vicinity thereof or if the ink, which adheres to the inner part of the discharge port or to the discharge port surface, is dried or becomes overly viscous, the ink discharge performance of the recording head 100 is made inferior eventually, resulting in disabled discharges or twisted discharges (that cause displacement of impact positions of ink droplets which have been discharged in irregular directions). Now, therefore, the description will be made, at first, of the recovery unit 300, which is used for the recovery and maintenance of the discharge performance by eliminating defective ink discharges such as disabled discharges, and twisted discharges, among some other defective discharges.

The recovery unit 300 embodying the present invention is provided with pre-discharge process means, wiping process means, and suction recovery process means as the main discharge recovery process means given below.

At first, the pre-discharge process means performs ink discharge from all the discharge ports 89 at predetermined timing at an area other than adjacent a recording sheet, that is, a designated area provided for the recovery unit 300 in accordance with the present embodiment. In this way, overly viscous ink in the discharge port or the vicinity of the discharge port is discharged or other kinds of ink, which enter the discharge port when plural kinds of ink are made dischargeable in the same recording apparatus, are discharged. The ink that has been discharged by the pre-discharge process is carried to a waste ink tank.

Also, the wiping process means is provided for wiping and removing the ink that adheres to the discharge port surface due to the mist that is generated simultaneously with the main ink droplets discharged for recording, or due to the splashed mist that is generated when the main ink droplets are impacted on a recording sheet, or by the suction recovery process, as described later, which is performed by sucking ink from the discharge port. Here, the wiping process means comprises the blade (wiper), which is formed of an elastic member such as rubber for wiping to clean (cleaning) the discharge port surface, and some other components.

Also, the suction recovery process means is arranged to push the cap, which is formed of rubber or some other elastic material, to the discharge port surface 88 of the recording head 100 to urge it in close contact therewith, and by use of pumping means, the inner pressure of the cap is reduced to less than the atmospheric pressure, thus forcibly removing ink from the discharge port. Then, together with the flow of ink, dust particles, dried ink, or all the elements that cause the discharge impedance, such as bubbles, in the discharge port are eliminated. The ink that has been sucked by the suction recovery process means is carried to the waste ink tank by an idle suction process, which will be detailed later.

Figure 2:
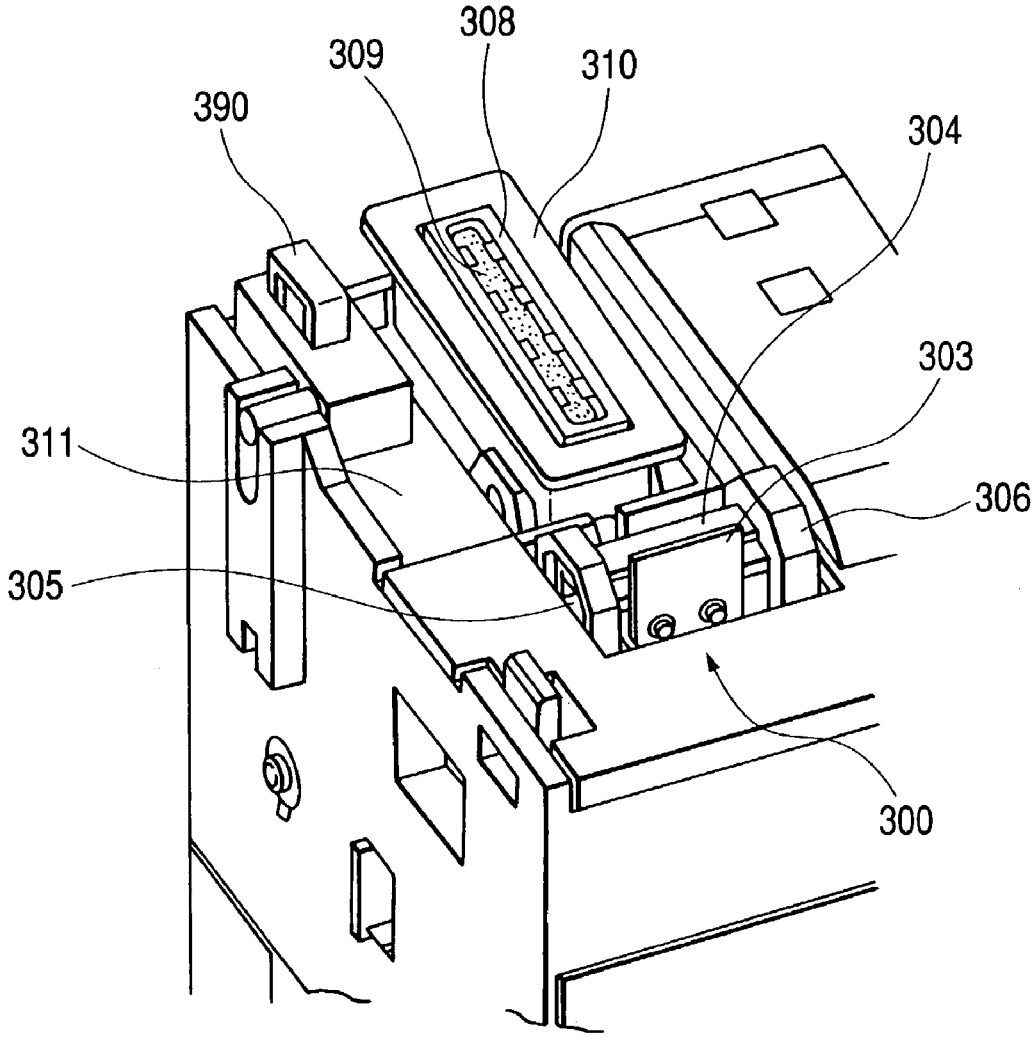
FIG. 2 is a perspective view that shows the structure of a recovery unit of the ink jet recording apparatus to which the present invention is applicable.

FIG. 2 is a perspective view that shows the structure of the recovery unit 300 of the ink jet recording apparatus to which the present invention is applicable. In FIG. 2, the recovery unit 300 is fixed to the frame unit 70, to which the guide shaft 201 and other carriage traveling guide members are fixed, hence securing the relative positions between the recovery unit 300 and the carriage unit 200 (the carriage and the recording head) in good precision.

In FIG. 2, reference numeral 303 designates the blade formed by a flat plate of elastic material, such as rubber. Each blade 303 is fixed to a blade holder 304. The blade holder 304 is elastically biased to engage with a blade shaft 305 by a blade spring (not shown) so that each blade 303 is in a rotative position in which the blade faces the recording head 100, that is, it is set in the upward direction. The blade shaft 305 is integrally formed with a blade gear 305*a*.

Also, the blade shaft 305 is formed to be rotative by blade driving means (not shown), and the blade holder 304 engaged with the blade shaft 305 and each blade 303 are also arranged to be rotative in the same manner together with the blade shaft 305. Further, for the blade holder 304, a blade cam 306 is integrally formed. Then, when the carriage unit 200 moves on wiping means in the direction indicated by an arrow A303, the blade cam 306 is pressed down elastically by the blade rib (not shown), which is arranged for the carriage. In this way, irrespective of the positional tolerance of installation between the recording head 100 and the recovery unit 300 in the height direction, the amount of intrusion is made always stable so as to make the wiping process executable in good condition at all times.

In FIG. 2, reference numeral 308 designates the cap, which is formed of an elastic material, such as rubber; and 309, a cap absorbent formed of a porous material such as polyethylene or the like, and which is provided inside of the cap 308. The porous material of the cap absorbent is formed by sintering powdered polyethylene having a diameter of approximately 0.3 mm. The pore ratio is approximately 40%, for example.

Reference numeral 310 designates the cap holder that holds the cap 308, and 311, a cap lever. The cap holder 310 is fixed to the cap lever 311 in such a manner that it is biased in the direction toward the recording head 100 through a cap spring (not shown). Also, the cap lever 311 is structured to be movable up and down for opening or closing the cap 308 by use of a cap lever cam (not shown) fixed to the camshaft of the recovery unit 300.

In other words, in FIG. 1 and FIG. 2, the carriage unit 200 is at the home position when it lies immediately above the recovery unit 300, and it is made movable in the direction indicated by the arrow A303 intersecting with (usually, orthogonal to) the conveying directions of a recording sheet indicated by arrows A305 and A306. When the carriage unit 200 is positioned above the conveying path of the recording sheet by moving it to one side of the recovery unit 300, recording is made possible on the recording sheet, which is conveyed in the direction indicated by the arrow A305. Also, when the carriage unit 200 moves to the other side (opposite side) of the recovery unit 300 so as to be positioned in the conveying path of the recording sheet, recording is made possible on the recording sheet conveyed in the direction indicated by the arrow A306.

In FIG. 2, reference numeral 390 designates a carriage lock arm, which engages with a hole provided in the carriage when capping the recording head 100 on the carriage 200 positioned immediately above the recovery unit 300, that is, when the cap lever 311 rises. By the function of the carriage lock arm 390, the carriage is fixed to a predetermined position so that any positional deviation should not occur between the recording head 100 and the cap 308 due to shocks or the like.

Also, a lock spring (not shown) is arranged between the carriage lock arm 390 and the cap lever 311, and the structure is arranged so as to enable the carriage lock arm 390 to be elastically lowered with respect to the carriage lever 311. In this manner, even if the carriage lock arm 390 abuts against a portion other than the hole that faces the carriage, the recovery unit 300 or the carriage unit 200 will not be damaged.

Figure 3:
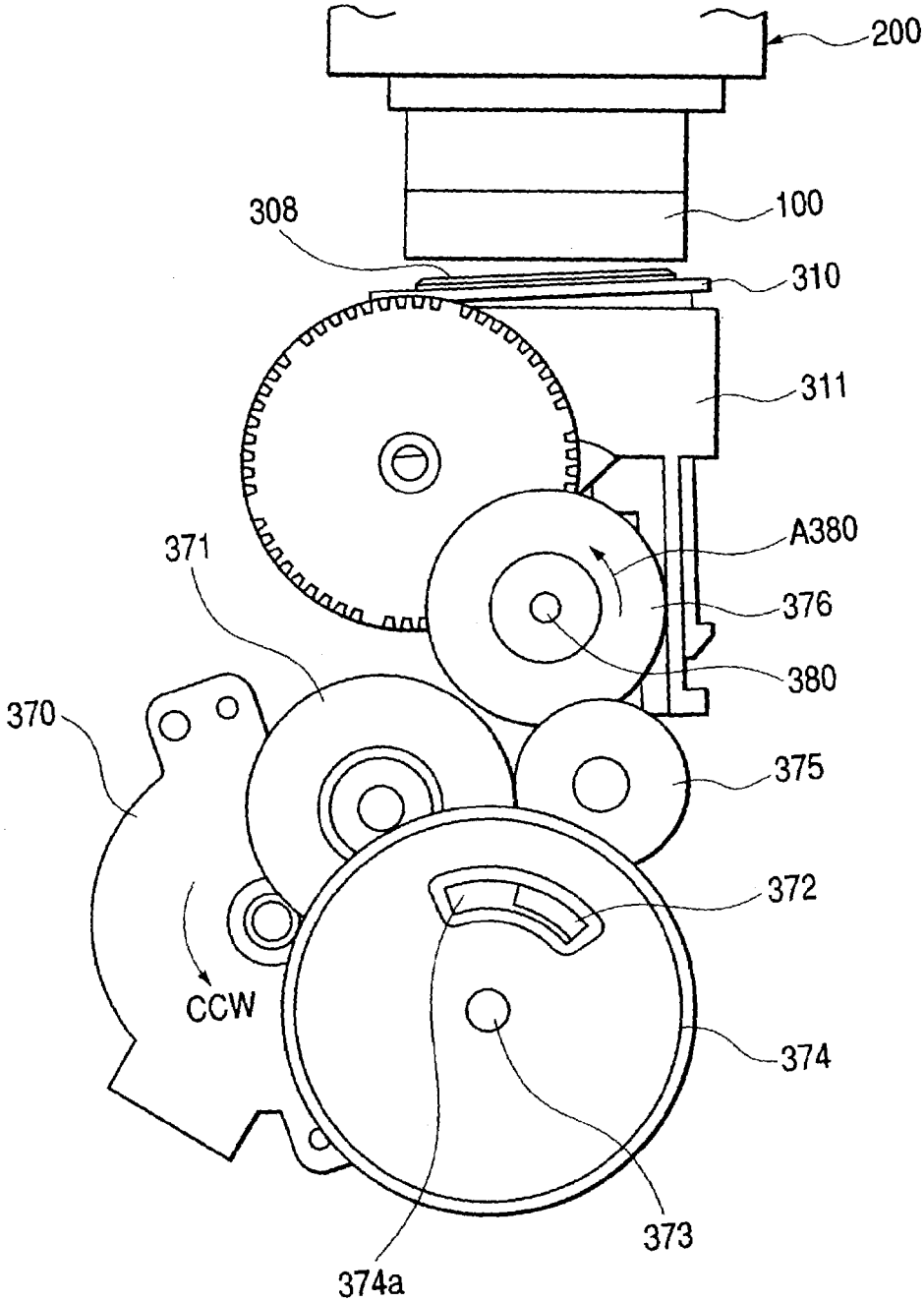
FIG. 3 is a side view that schematically shows a driving mechanism of the recovery unit represented in FIG. 2.

FIG. 3 is a side view that shows the structure of the driving systems of the recovery unit 300 represented in FIG. 2, and also, the relations between the cap and the recording head. In FIG. 3, reference numeral 370 designates a motor dedicated for use in the recovery systems, and which is provided with a gear fixed to the rotational shaft thereof; 371, a first double gear for speed reduction use, and which is an intermediate gear of the motor; and 372, an idler gear, which is formed to engage with the first double gear 371, while rotating around the pump shaft 373 to which is fixed a roller guide of a tube pump 324 to be described later.

In FIG. 3, a reference numeral 374 designates a pump cam, which is fixed to the pump shaft 373, and provided with a cut-off portion 374*a* that engages with a rib provided for the idler gear 372. Between the rib and the cut-off portion 374*a*, play having a predetermined angle (rotational angle of 550, for example) is provided. Reference numeral 375 designates a second double gear that engages with the idler gear 373; and 376, a one-way clutch formed integrally with the gear that generates tightening torque only when it rotates in a predetermined direction.

The one-way clutch 376 enables a camshaft 380 to rotate for driving by generating the tightening torque to the camshaft 380, which is the rotational center of the clutch, only when it rotates in the direction indicated by an arrow A380 in FIG. 3 (that is, in the CCW direction). In other words, only when the motor 370 dedicated for use in the recovery systems driving rotates in the CCW (counterclockwise) direction indicated by the arrow in FIG. 3, is the camshaft 380 of the recovery unit 300 enabled to rotate for driving by the rotation of the one-way clutch 376 in the direction indicated by the arrow A380 (CCW direction). On the other hand, when the motor 370 dedicated for use in the recovery systems driving rotates in the CW (clockwise) direction, which is opposite to the direction indicated in FIG. 3, the one-way clutch 376 is freed, and the camshaft 380 of the recovery unit 300 does not rotate. Then, the pump shaft 373 begins to rotate with the predetermined play.

With the structure thus arranged, when rotating the pump regularly to generate suction pressure, no driving power is transmitted to the cap and the valve mechanism. Here, on the contrary, the pump rotates reversely in driving the cap to enable the roller to retract.

Also, the downward discharge port surface 88 of the recording head 100 is inclined at an angle of approximately 5 degrees to the horizontal plane. On the other hand, the cap 308, which is in the opening state, is inclined at an angle of approximately 3 degrees to the discharge port surface 88. Therefore, the abutting surface of the cap 308 against the discharge port surface 88 is inclined at an angle of approximately 2 degrees to the horizontal plane. Here, the position of a suction port 382 provided for the cap 308 (see FIGS. 4A to 4C) is at the right end of the cap 308 in FIG. 3 and FIGS. 4A to 4C, that is, on the lower part of the inclined cap 308 (having an inclination toward the lower right at an angle of approximately 2 degrees to the horizontal plane). In this respect, the suction port 382 is connected with the tube pump 324 (see FIG. 5 and FIG. 6) serving as the supply source of negative pressure through the cap tube 338.

Figure 4A:
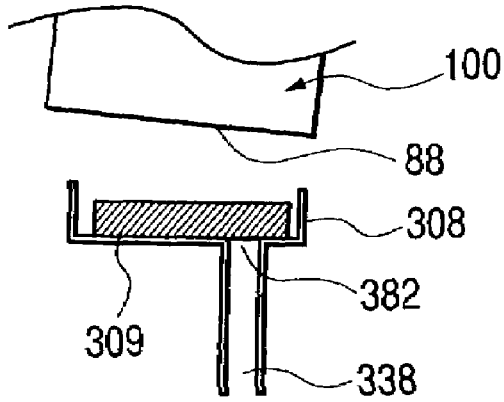
FIGS. 4A, 4B, and 4C are cross-sectional views that schematically illustrate the positional posture of a cap of a discharge recovery device with respect to recording means for the ink jet recording apparatus to which the present invention is applicable.
Figure 4B:
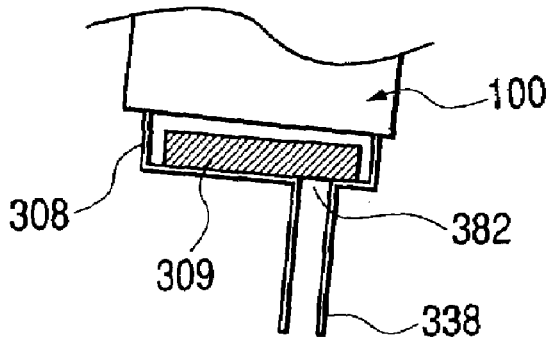
Figure 4C:
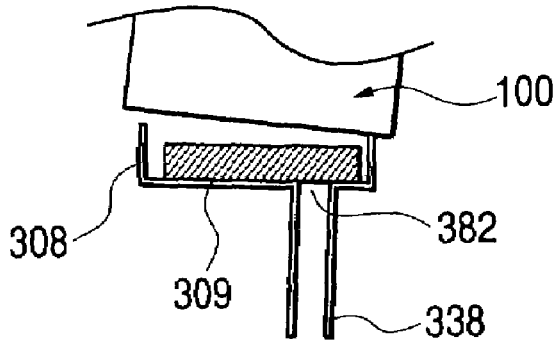

FIGS. 4A, 4B, and 4C are cross-sectional views that schematically illustrate the positional posture of the cap 308 with respect to the recording head 100; FIG. 4A shows the condition under which the cap is open during the recording operation or the like; FIG. 4B shows the capping condition at the time of executing the suction recovery process or the like; and FIG. 4C shows the condition under which the side opposite to the suction port 382 of the cap 308 is parted from the discharge port surface 88, while enabling the cap to be inclined at the time of the idle suction or the like.

During the recording operation or the like, the cap 308 is kept away from the discharge port surface 88 of the recording head 100 as shown in FIG. 4A.

When the suction recovery process is performed, the cap-lever cam (not shown), which is fixed to the camshaft 380, is driven to rotate to raise the cap lever 311 as shown in FIG. 4B. In this manner, the cap 308 is biased elastically to be closely in contact with the discharge port surface 88 of the recording head 100. In the capping condition where the discharge port 89 is airtightly closed with the close contact of the cap 308, the suction pump (tube pump) 324 is driven to make the interior of the cap 308 negatively pressurized, thus sucking ink from the discharge ports 89 for the execution of the suction recovery.

After the execution of the suction recovery process, the idle suction is executed in order to discharge remaining ink in the cap 308, a cap tube 338, and other components for the removal thereof. The idle suction is performed in such a manner that while the cap 308 is inclined as shown in FIG. 4C, a part of the cap rib (air tightening rib) positioned on the opposite side of (the side opposite to) the suction port 382 of the cap is allowed to part from the discharge port surface 88, and then, the suction pump 324 is driven to enable the air to flow into the inside of the cap 308 forcibly and continuously, thus discharging the ink that has adhered to the inside of the cap 308 and the discharge port surface 88 for removal by sucking such ink together with the air. At this juncture, the portion where the suction port 382 is arranged for the cap 308 is slightly lower than the horizontal plane. As a result, there is no fear that ink inside the cap 308 runs over or drops off. Also, the discharge port surface of the recording head 100 is lowered (inclined) toward the suction port 382. Therefore, the ink that has adhered to the discharge port surface 88 flows to the suction port 382 side, and accumulates in the vicinity of the suction port 382.

In this respect, the forcible and continuous in-flow of the air into the cap 308 means that the air flows instantaneously when the cap 308 is released in an inclined orientation, and also that the air is continuously taken into the cap 308 by driving the suction pump 324 under the condition described above. In addition to the idle suction as described, the suction pump may be driven intermittently, for example, which is also within the scope of the present invention. The intermittent suction makes it possible to enhance the ink collection ratio more than the continuous idle suction, because such suction time enables ink to be condensed by the surface tension of the ink itself.

Also, in the case of the pigment ink that makes clogging easier, there is a need for the provision of large pores for the cap absorbent 309 so as to make the occurrence of clogging difficult. With the pores being made larger, the holding power of the cap absorbent becomes weaker against the ink that has been absorbed in the cap absorbent. Then, ink tends to flow more easily in the vertical direction and drop off. In this case, therefore, the suction port 382 is arranged at the lower end portion of the inclination of the cap 308, thus making it more effective to collect ink. After sufficient idle suction, the cap 308 is again kept in the cap open condition as shown in FIG. 4A where it is parted from the discharge surface 88 of the recording head 100 completely. In this cap open condition, the wiping process for the discharge port surface 88, the pre-discharge process for the discharge ports 89, and some other functions are executed, and lastly, the idle suction for the cap 308 is executed. Then, the cap 308 is pressed in contact with the discharge port surface 88, thus keeping it in the capping condition as shown in FIG. 4B.

In this respect, when the cap is in the cap open condition, ink in the cap is removed sufficiently. Therefore, there is no possibility of any drawback such as ink running out of the cap. Thus, there is no problem even if the cap 308 is parallel to the discharge port surface 88 in a substantially horizontal orientation. Here, if the cap is conditioned to be in parallel therewith, a projection area on the inner side of a cap rib (circumferential airtight portion) becomes the largest against the discharge port surface of the recording head 100. As a result, it becomes possible to provide the maximum displacement margin when the pre-discharges are effectuated in the cap. In addition, it is made possible to expand the clearance between the discharge port surface and the cap.

Also, in accordance with the present embodiment, the suction pump begins to be driven after the cap 308 is inclined to release only the one side portion thereof, but it may be possible to arrange the structure so that the releasing operation of the cap 308 and the driving of the suction pump can be performed at the same time in the transition process from the airtight condition (capping condition) as shown in FIG. 4B to the releasing of one side portion as shown in FIG. 4C. With the structure thus arranged to make the simultaneous drive (simultaneous operation) possible, the enhancement of the throughput of the recording operation and recovery process operation is made attainable, while achieving further reduction of ink remaining in the cap 308.

In this respect, the movement of the cap 308 is not necessarily limited to that described in the present embodiment. For example, the cap may be released by reversing the inclination as if it were rotated. More specifically, the structure may be arranged so that the cap 308 is inclined to the recording head 100 so as to enable the opposite side of (the side opposite to) the suction port 382 to be apart, and after that, the portion on the opposite side of the suction port 382 is lowered. With the structure thus arranged, it is not always necessary to incline the recording head 100 relative to the horizontal plane. The same functional effect is attainable even if the cap is kept horizontal.

Figure 5:
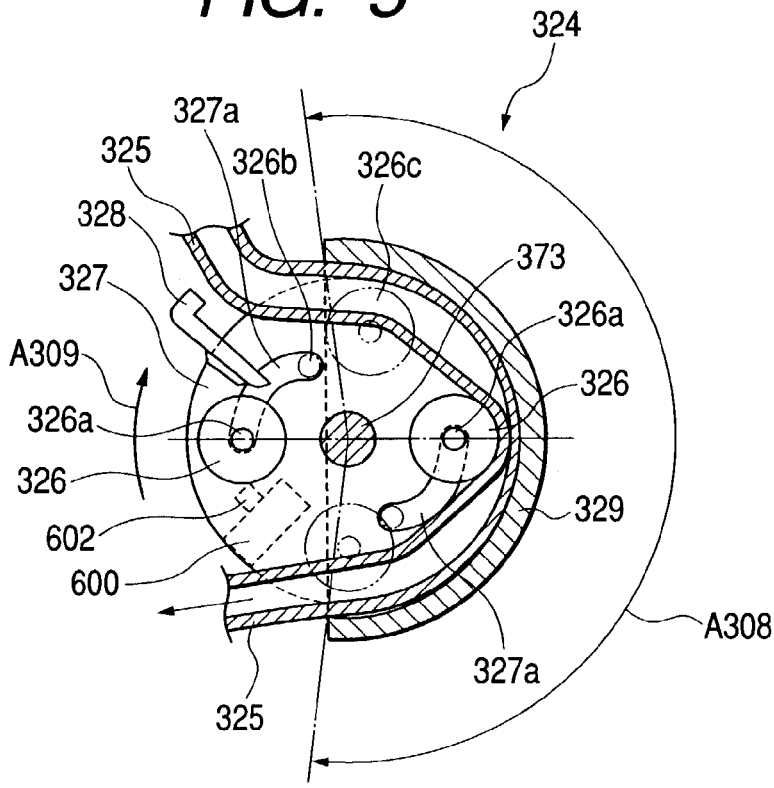
FIG. 5 is vertically sectional view that shows the state of generating negative pressure by a tube pump serving as negative pressure generating means for the recovery unit of the ink jet recording apparatus to which the present invention is applicable.
Figure 6:
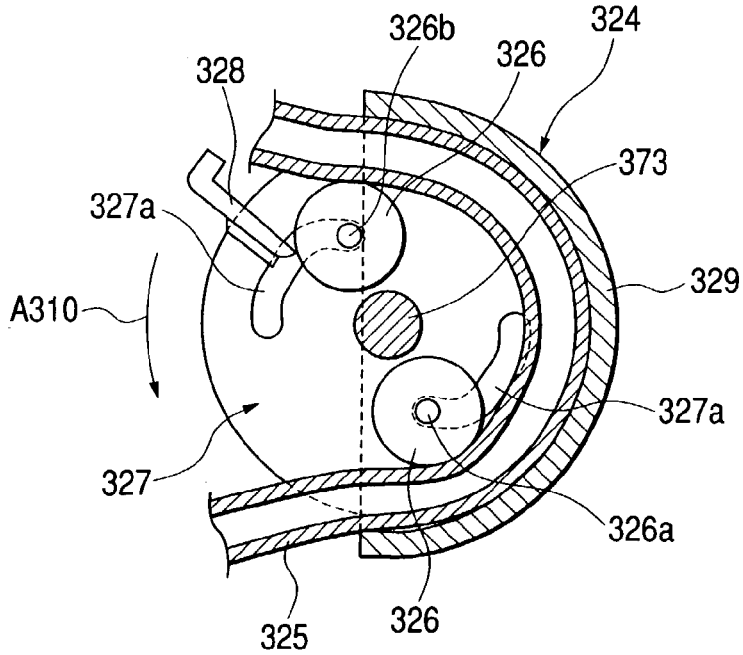
FIG. 6 is vertically sectional view that shows the state of releasing the compression squeeze of the pump tube by rotating the tube pump represented in FIG. 5 in the opposite direction.

Next, in conjunction with FIG. 5 and FIG. 6, description will be made of the structure of the tube pump 324. FIG. 5 is a vertical sectional view that shows the state of the tube pump 324 as negative pressure generating means, in which negative pressure is exerted. FIG. 6 is a vertical sectional view that shows the state in which the tube pump 324 represented in FIG. 5 rotates in the opposite direction (the direction indicated by an arrow A310).

In FIG. 5 and FIG. 6, reference numeral 325 designates the pump tube formed of silicone rubber; 326, rollers that squeeze the pump tube 325 to generate negative pressure inside the pump tube; and 326*a*, shaft portions arranged on both sides of the rollers 326. The rollers 326 are capable of pressing and squeezing the pump tube 325 while rotating (revolving) along with the rotational movement (revolution) of a roller guide 327, and are arranged in two locations with 180-degree phase deviation.

Reference numeral 327 designates the roller guide that supports each roller 326 to be rotative (freely rotational); and 327*a*, grooves provided for the roller guide 327 corresponding to each roller 326. Into each of the grooves 327*a*, the shaft portions 326*a* arranged on both sides of the corresponding roller 326 are inserted. Each roller 326 is structured to be movable along each groove 327*a*. Reference numeral 328 designates a roller damper, which is formed of an elastic material such as rubber, to reduce noises generated by the movement of the rollers 326.

In FIG. 5, which shows the state where negative pressure is generated by the operation of the tube pump 324, each roller 326 moves to the end portion on the outermost circumference of the groove 327*a* of the roller guide 327. In this state, when the roller guide 327 rotationally moves (revolves) in the direction indicated by an arrow A309 (normal direction), each roller 326 rotates (revolves), while rotationally moving to press and flatten the pump tube 325, thus squeezing the pump tube 325. In the area outside the area A308 where the pump tube is squeezed, the roller dumper 328 keeps the roller 326, which is freely movable in the groove 327*a*, in a condition under which the roller is brought exactly to one end portion of the groove 327*a* (the end portion on the outermost circumference of the roller guide 327). Although the two rollers 326 are given 180-degree phase deviation, since a tube guide 329, which guides and holds the pump tube 325 in the form of arc, is arranged for an area greater than 180 degrees as indicated at A308, it is possible to generate negative pressure continuously by squeezing the pump tube 326 continuously and endlessly during the rotational movement of the roller guide 327 in the direction indicated by the arrow A309 (normal direction).

FIG. 6 shows the condition in which the roller guide 327 rotates in the direction (indicated by an arrow A310) that is opposite to the one represented in FIG. 5. In the condition shown in FIG. 6, each roller 326 is pushed in the groove 327*a* in the direction opposite to the one shown in FIG. 5 due to a load exerted by interference with the pump tube 325, such that each roller 326 is in the condition (retracted condition) where it escapes toward the rotational center of the roller guide 327 (in the direction of the pump shaft 373). Therefore, each roller does not squeeze the pump tube 325, and virtually, it rotates idly. As a result, negative pressure is not generated. Further, there is no concern that the pump tube 325 is squeezed to create creeping. It is desirable to assume the condition shown in FIG. 6 if any suspension for a long time is expected due to turning-off of the power supply or standby of recording.

In FIG. 5, the tube pump 324 is provided with a photo-interrupter 600, and with a flag 602 arranged for the roller guide 327, the phase-angle position of the rollers 326 can be detected in the rotational direction. With the structure thus arranged, even if settling occurs in the pump tube 325, or when the roller guide 327 rotates reversely, that is, in the direction indicated by an arrow A310 under a smaller load that the rollers 326 receive from the tube 325 due to indentations occurring at positions in the grooves 327*a* of the roller guides 327 of the shaft positions 326*a* of the rollers 326, which indentations are caused by the sliding friction with the rotational shaft portions of the rollers 326, or even if the rollers 326 are not made retractable to the positions shown in FIG. 6 due to an increased loading force needed for the rollers 326 to retract, to thereby bring about the reverse rotation in positions at 326*a* in FIG. 5, the distance for the rollers 326 to squeeze the tube 325 can be controlled to be extremely short by retaining the roller positions in the vicinity of the end portions of the tube guide (tube regulation surface) 329 before the initiation of the reverse rotation.

In other words, it is possible to keep the positions of the rollers 326 at the shaft portions 326*c* as shown in FIG. 5 before beginning the reverse rotation, that is, to stop the position in the vicinity of the tail end portions of the tube guide 329 (or at the positions in the vicinity of the head end portions depending on the direction in which the roller guide 327 rotates). In this way, when the roller guide 327 rotationally moves and comes to the area where the tube guide (regulation surface) 329, which regulates the position of the tube 325 against the compression of the rollers 326, does not exist, the tube 325 is no longer compressed necessarily, irrespective of the retracted state of the rollers. Further, when the rollers 326 reversibly rotate and come to the lowermost point in FIG. 5, the rollers 326 interfere with the tube 325, and due to the charged resistance, the rollers 326 move to the position indicated by the shaft portion at 326*b*, thus preventing the opposite flow in the tube pump 324.

Here, at this juncture, the force needed for moving the roller 326 from the position (compressed position) indicated by the shaft portion 326*a* to the position (idly rotational position) indicated by the shaft portion 326*b* is extremely small, and the roller 326 can be retracted reliably irrespective of the settling condition of the tube 326. The rollers 326 move in the vertical direction in FIG. 5 by gravitational force, and travel to the positions indicated by the shaft portion 326*b*. Then, thereafter, the rollers do not press the tube 326 even if the tube pump 324 continues rotating reversibly.

Figure 7:
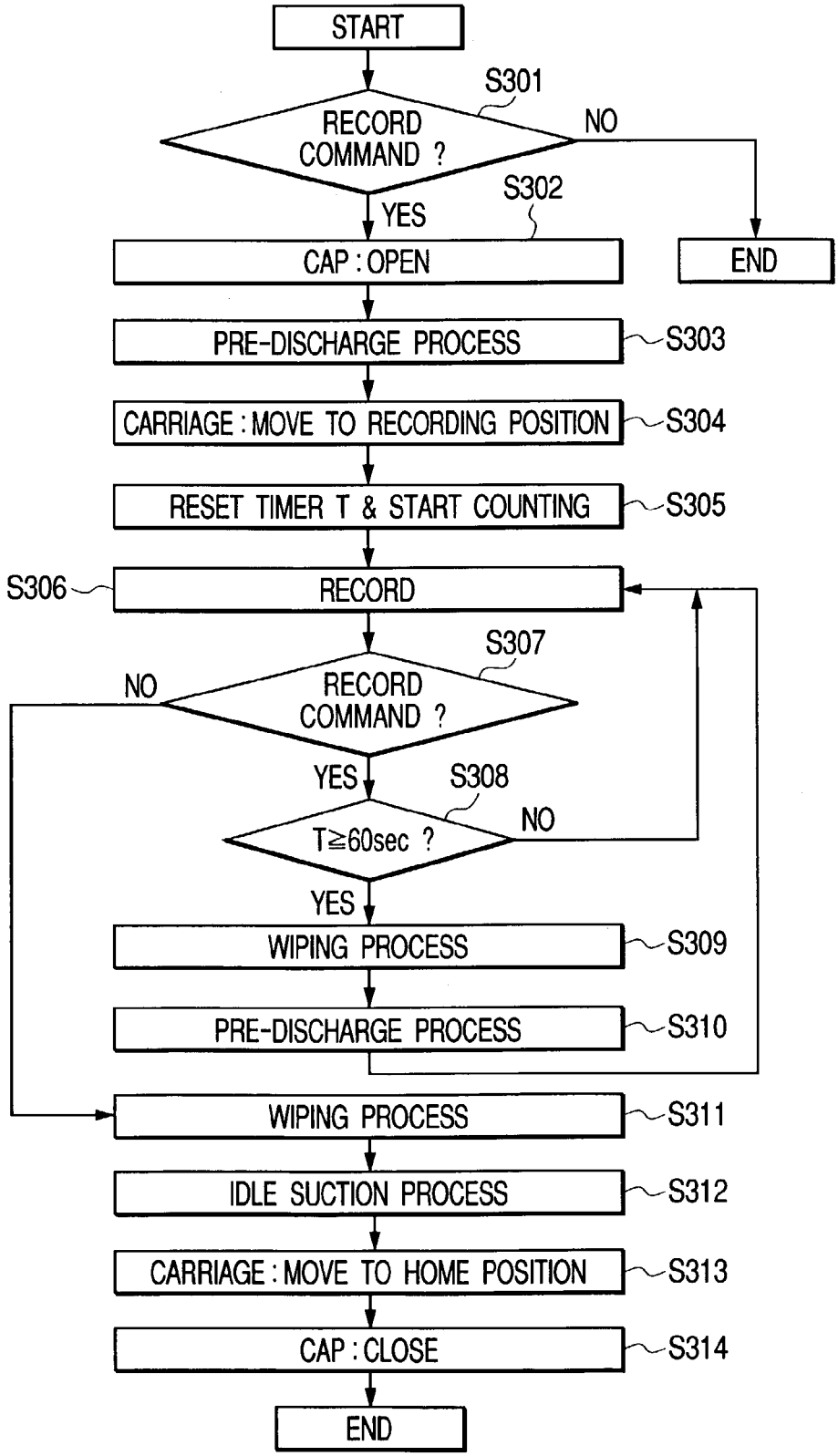
FIG. 7 is a flowchart that shows a series of recording operations and recovery processes in the ink jet recording apparatus to which the present invention is applicable.
Figure 8:
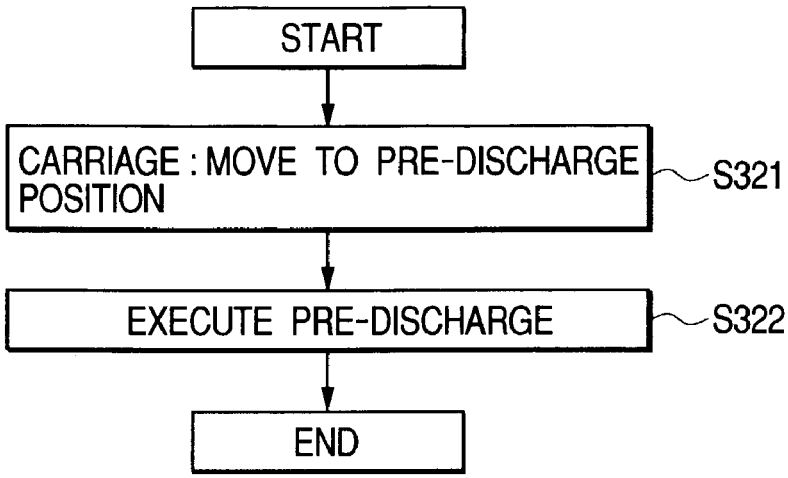
FIG. 8 is a flowchart that shows an operation of a pre-discharge process described in FIG. 7.
Figure 9:
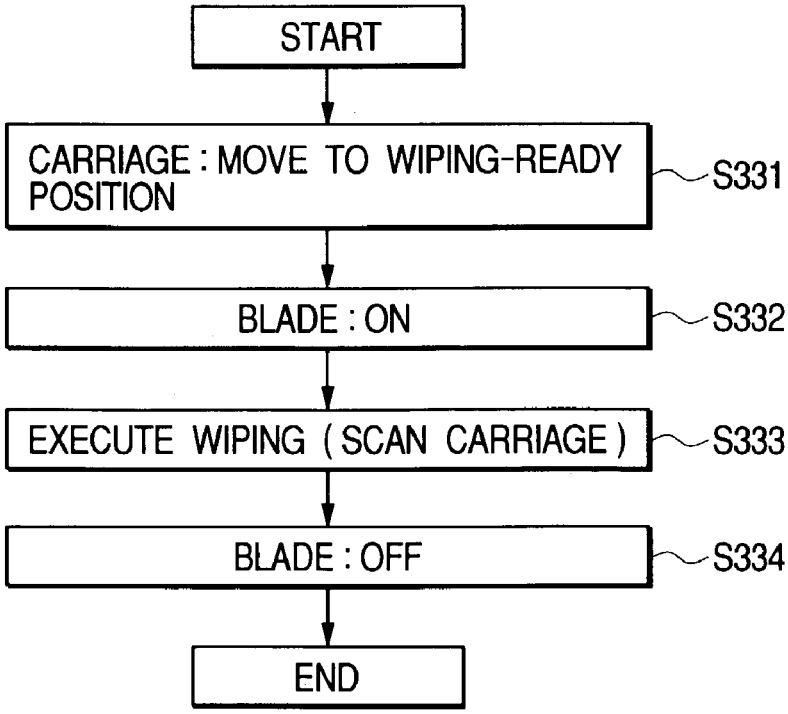
FIG. 9 is a flowchart that shows an operation of a wiping process described in FIG. 7.
Figure 10:
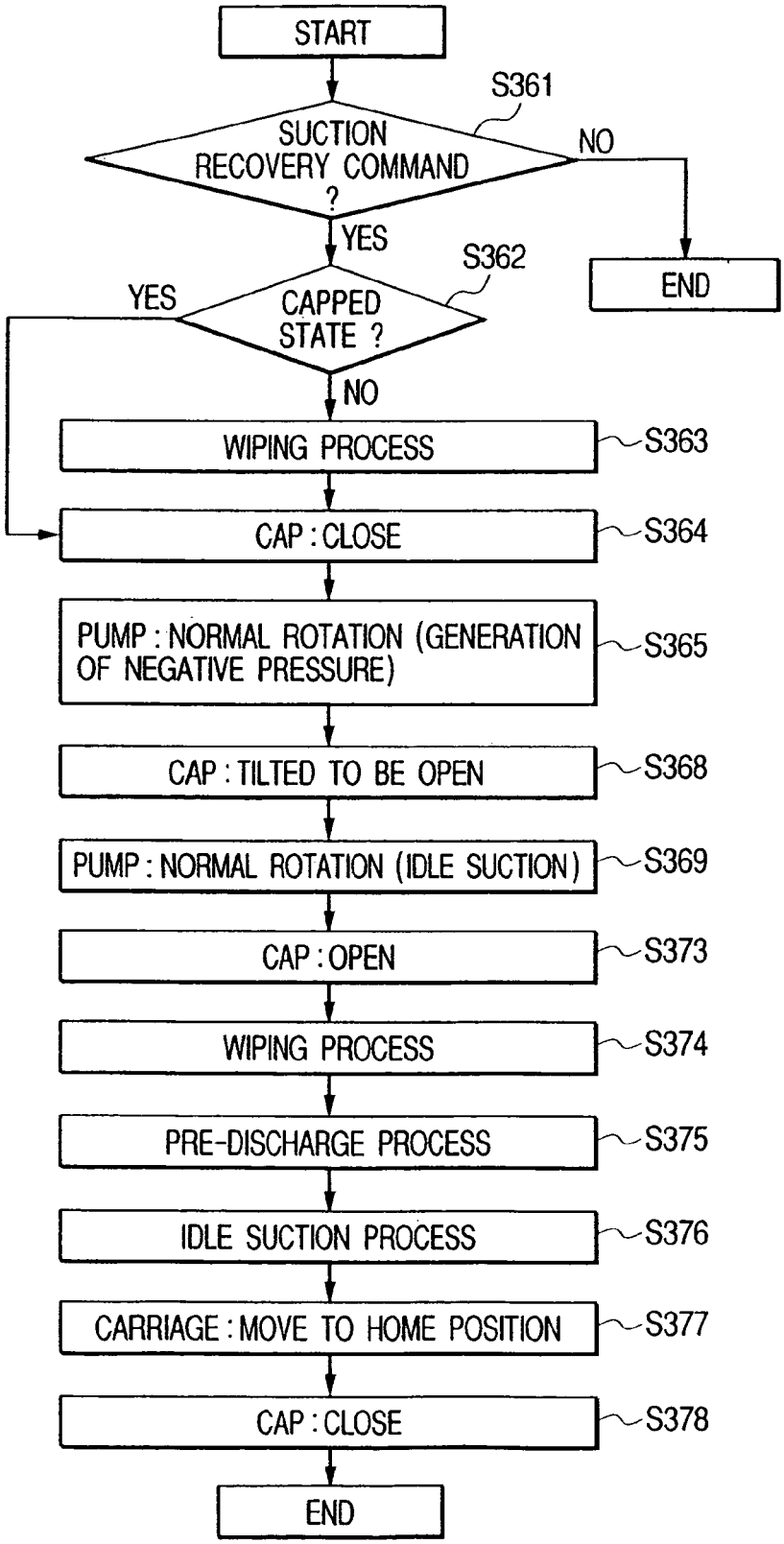
FIG. 10 is a flowchart that shows the operation of the suction recovery process described in FIG. 7.

FIG. 7 is a flowchart that shows a series of operations of the recording process and discharge recovery process for the ink jet recording apparatus in accordance with the present embodiment. FIG. 8 is a flowchart that shows the operation of the pre-discharge process in FIG. 7. FIG. 9 is a flowchart that shows the operation of the wiping process in FIG. 7. FIG. 10 is a flowchart that shows the operation of the suction recovery process in FIG. 7. Next, in conjunction with FIG. 7 to FIG. 10, description will be made of the series of the recovery process operations at the time of recording.

In FIG. 7, when a recording instruction is received in step S301, the motor 370 dedicated for use of recovery systems driving begins to rotate in step S302 in the CCW direction (counterclockwise direction) in FIG. 3. Then, the camshaft 380 rotates in the direction indicated by the arrow A380, thus opening the cap. Here, the pre-discharge process shown in FIG. 8 is carried out for the execution of pre-discharges.

In the pre-discharge process (FIG. 8), the carriage 200 moves to the pre-discharge standby position in step S321. Then, in step S322, the pre-discharge is executed. With the completion of pre-discharges for all the discharge ports, ink discharge is suspended to end the pre-discharge process.

Next, in FIG. 7, the carriage unit 200 moves in step S304 to the recording position (in accordance with the present embodiment, the recording position can be selected from either one of the recording positions arranged on both sides of the recovery unit 300). Then, in step S305, the timer T is reset to zero, and counting begins. In step S306, the carriage unit 200 discharges ink in accordance with recording information onto a recording sheet that has been conveyed to the recording position on the side where the carriage unit is positioned.

Next, in step S307, whether any recording instruction is present or not is determined. If not, the process proceeds to step S311 where the wiping process is executed (FIG. 9).

If any recording instruction is present in step S307, the timer T is referenced in step S308. If the timer T is less than 60 sec., the process returns to step S306 where recording is continued. If the timer T is 60 sec. or more, the wiping process (FIG. 9) is executed in step S309 for wiping off the ink that adhered to the discharge port surface 88, while in step S310 the pre-discharge process (FIG. 8) is executed. The operations from step S306 to step S310 are repeatedly performed until it is determined in step S307 that there is no longer any recording instruction. In this respect, the pre-discharge process in step S310 is the operation for discharging dried ink, ink of a different kind, or the like that may be pushed into the discharge ports of the recording head 401 by the wiping process executed in step S309. Then, in step S307, if it is determined that there is no longer any recording instruction, the process proceeds to step S311 where the wiping process (FIG. 9) is executed as described earlier.

In the wiping process shown in FIG. 9, the carriage unit 200 moves to the wiping standby position in step S331. In continuation, the motor 370 rotates in the CCW direction in step S332. Then, the leading end of the blade 303, which is in the downward direction, shifts to the condition where it is in the upward direction so that wiping is made possible (blade ON). Next, in step S333, the carriage unit 200 moves and performs the wiping of the discharge port surface 88. The traveling speed of the carriage unit 200 is not necessarily constant. It may be possible to change the speeds depending on the kinds of ink, for example. After all of the area of the discharge port surface of the recording head 100 is wiped (cleaned by wiping) by the blade 303, the carriage unit 200 stops, and in step S334, the motor 370 rotates in the CCW direction to store the blade 303 downward, thus completing the wiping process. In this respect, since the rotation mechanism of the blade 303 is not directly concerned with the present invention, a detailed description thereof will be omitted.

After the ink is removed from the discharge port surface, the motor 370 rotates in the CW direction to drive the pump 324 for the idle suction process in step S312 in order to discharge the ink, which is still retained in the cap 308, to waste ink process means (not shown).

Next, in step S313, the carriage unit 200 moves to the home position, that is, the capping position facing the recovery unit 300, and in step S314, the motor 370 rotates in the CCW direction to cap the recording head 100, thus completing the series of operations of the recording process.

In a case where the recording head 100 is not in use for a long time, ink in the discharge port is solidified and fixed thereto or discharge defects (including disabled discharge) may take place due to the mixture of air-bubbles in the discharge port. In order to recover and maintain the ink discharge performance by eliminating such discharge defects, the suction recovery process, such as shown in FIG. 10, is executed automatically or manually.

Next, the suction recovery process will be described. In FIG. 10, a suction recovery instruction is received in step S361. Then, in step S362, detection is made to ascertain the current status of the recording apparatus. Here, if the recording apparatus is on standby and the recording head 100 is capped, the process proceeds to step S364 (cap closed). Otherwise, the process proceeds to step S363 where the wiping process is executed, and after that, capping is made in step S364. Next, in step S365, the motor 370 rotates in the CW direction to drive the pump 324, thus exerting negative pressure in the cap. The suction recovery operation is performed to suck ink from the discharge ports 89 by means of the suction operation (by means of the negative pressure thus exerted) in the capping condition in step S365.

In continuation, after the execution of the suction recovery operation (step S365) to suck ink from the discharge ports 89 in a predetermined amount, the motor 370 rotates in the CCW direction in step S368 to lower the cap 308 while causing it to incline diagonally. Thus, the portion on one side of the cap is allowed to part from the discharge port surface 88 of the recording head 100, and release the inside of the cap to the atmosphere. Next, in step S369, the motor 370 rotates in the CW direction to actuate the pump 324 serving as negative pressure generating means for the execution of the idle suction process to suck ink remaining in the cap 308, the cap tube 338 and the pump tube 325. Then, sucked ink is discharged to the waste ink process means.

In continuation, in step S373, the cap 308 is allowed to part from the discharge port surface 88 to provide the cap open condition. Then, in step S374, the aforesaid wiping process is executed; in step S375, the pre-discharge process is executed; and in step S376, the idle suction process is again executed. Thus, lastly, in step S377, the carriage unit 200 moves to the home position, and in step S378, the motor 370 rotates in the CCW direction to keep the recording head 100 in the capped state (in the condition where the discharge ports 89 are covered) to complete the series of operations of the suction recovery process.

Here, in accordance with the present embodiment, the camshaft 380 is provided with a cap cam (not shown) fixed thereto, and also, a cap cam sensor is provided, and which is formed at a photo-interrupter having the cap cam as a flag. Then, the structure is arranged so as to detect the phase of each of the cams including the one used for the up and down driving of the cap fixed to the camshaft 380 (that is, used for the opening and closing operations of the cap 308) by the result of detection effectuated by the cap cam sensor.

Second Embodiment

Figure 11:
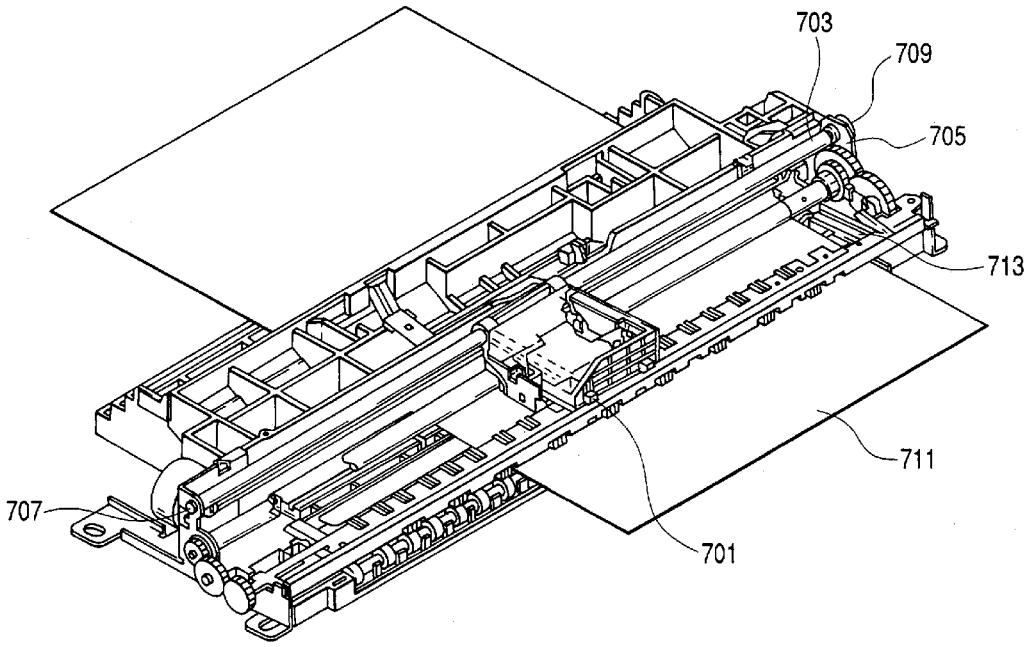
FIG. 11 is a perspective view that schematically shows a second embodiment of the ink jet recording apparatus to which the present invention is applicable.
Figure 12:
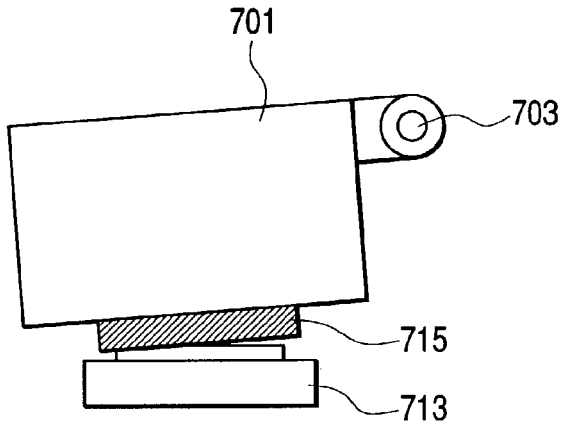
FIG. 12 is a side view that schematically shows the posture of recording means and the cap when the idle suction is performed for the ink jet apparatus represented in FIG. 11.

FIG. 11 is a perspective view that schematically shows a second embodiment of the ink jet recording apparatus to which the present invention is applicable. FIG. 12 is a side view that schematically shows the posture of the recording head and cap when idle suction is performed for the ink jet recording apparatus represented in FIG. 11.

For the first embodiment described above, the structure is arranged so that the idle suction is executed while a part of the cap is released by inclining the cap 308 to the discharge port surface 88 of the recording head 100, thus allowing the cap to part from the discharge port surface. However, the present invention is not necessarily limited to such structure. For example, as shown in FIG. 12, the structure may be arranged so that the idle suction is made executable while releasing a part of a cap 713 by inclining a recording head 715 to the cap 713 so as to allow the head to part from the cap in the diagonal direction.

In FIG. 11 and FIG. 12, the discharge port surface (lower face) of the recording head 715 is arranged to be substantially in the horizontal direction. A guide shaft 703 that guides the movement of a carriage 701 is fixed to a frame 705 of the recording apparatus at both ends thereof, and portions 707 to be fixed to the frame 705, each arranged for either end of the guide shaft 703, are made eccentric. Also, one end portion of the guide shaft 703 is fixed to a gear 709. The gear 709 rotates by driving driving means (not shown), which is connected with the gear 709, thus making it possible to adjust the rotational position of the guide shaft 703.

In other words, with the adjustment of the rotational position of the guide shaft 703, the postures of the carriage 701 and the recording head 715 mounted on the carriage 701 (the angles thereof relative to the horizontal plane) can be adjusted. In this respect, angle adjustment means as described can be used as means for adjusting the distance to a recording sheet, that is, the distance between the discharge port surface of the recording head 715 and a recording sheet 711 (recording material) to be conveyed on the lower side thereof.

Then, when the cap 713 and the discharge port surface of the recording head 715 are made apart, driving means is actuated to rotate the guide shaft 703 to incline the discharge port surface of the recording head 715 at a designated angle relative to the horizontal direction. As a result, the recording head 715 parts from the cap 713 while being inclined as shown in FIG. 12, and a part of the cap 713 on the guide shaft 703 side is released diagonally to the discharge port surface of the recording head 715. In other words, in accordance with the second embodiment, too, it is made possible to release the portion of the cap on the side opposite to the suction port side, while inclining it diagonally to the discharge port surface of the recording head.

In accordance with the second embodiment, there is no need for inclining the recording head in advance from the horizontal position thereof. Also, it may be possible to move the cap up and down while maintaining the posture of the cap horizontally.

In this respect, if the situation is such that the cap opening is impossible only by the inclination of the recording head 715, it may be possible to execute the operation of inclining the recording head in combination with the parting operation of the cap (including the inclining and rotating operations thereof). Here, the mechanism for raising the recording head (the inclination mechanism thereof) described in conjunction with FIG. 11 and FIG. 12 is not necessarily arranged to dually function as the mechanism to adjust the distance to the recording sheet, which is made capable of adjusting a distance between a recording head and a recording material (such as recording sheet) (that is, a clearance between a head and a recording sheet). This mechanism may be arranged to be dedicated for opening and closing a cap only.

In this respect, the present invention is widely applicable to the serial type recording apparatus in which recording is performed with main scans in the direction intersecting with the conveying direction of a recording sheet, the line type recording apparatus in which recording is performed only with sub-scans in the conveying direction of a recording material, or the like, irrespective of the recording methods to be adopted, and the same functional effects can be demonstrated in each apparatus.

Also, the present invention is equally applicable to the recording apparatus that records using one recording means, the color recording apparatus that uses plural recording means for recording in inks of different colors, or the gradational recording apparatus that uses plural recording means for recording in one color but in different densities, or, further, the recording apparatus in which these methods are combined, and the same effects are attainable in each apparatus.

Furthermore, the present invention is equally applicable to the structure that uses an exchangeable head cartridge in which a recording head and an ink tank are integrally formed, the structure that adopts a recording head and an ink tank as separate members, which are connected by use of an ink supply tube or the like, and other structures irrespective of the structures of the recording head and ink tank arrangement, and the same effects are obtainable in each structure. Here, in the case of the ink jet recording apparatus, the present invention is of course applicable to the one provided with recording means that uses electromechanical converting members, such as piezoelectric elements, or the like, and applicable to the ink jet recording apparatus that uses recording means having the method of discharging ink by the utilization of thermal energy, because with this method, it is possible to attain highly precise recording in high density.

As is clear from the above description, the ink jet recording apparatus that records by discharging ink from recording means is provided with the cap, which covers the discharge ports of recording means; suction means for sucking ink from the discharge ports of the recording means; and the ink flow path that connects the suction port formed for the cap to the aforesaid suction means in accordance with the present embodiment, and at least, when the cap is released after the suction recovery process, the portion of the cap on the side opposite to the suction port is made apart from recording means diagonally with the posture inclined to the recording means, and the structure is arranged so that the posture of the cap after having parted from recording means is made horizontal or made slightly lower on the portion on the suction port side. Therefore, when idle suction is effectuated inside the cap after the cap has been parted immediately after the suction recovery process or the like, it becomes possible to suck and remove ink remaining in the cap and other components efficiently, hence minimizing the amount of ink remaining in the cap, on the discharge port surface of recording means, or the like, for the provision of the ink jet recording apparatus capable of maintaining the ink discharge performance thereof stable at all times.

What is claimed is:

1. An ink jet recording apparatus for recording by discharging ink from recording means of which a discharge port surface is inclined to a horizontal plane, said apparatus comprising:

a cap for covering the discharge port surface of the recording means, said cap comprising a suction port, which is arranged at a side lower than horizontal under the capping condition;

a pump for effecting suction of ink from the recording means by generating negative pressure in said cap;

an ink flow path connecting the suction port to said pump; and control means for controlling movement of at least one of said cap and the recording means to position said cap apart from the discharge port surface, said control means controlling movement of the at least one of said cap and the recording means such that a side of said cap opposite to the side where the suction port is arranged is parted from the discharge port surface, and when said cap and the recording means are positioned apart, said cap may be horizontally postured or the suction port may be positioned lower than horizontal.

2. An ink jet recording apparatus according to claim 1, wherein when said cap is positioned apart from the recording means, said cap performs idle suction with said cap being horizontally postured or in a posture having the side of the suction port positioned lower than horizontal.

3. An ink jet recording apparatus according to claim 1, wherein an inclined angle of the recording means to the horizontal plane is more than an inclined angle of said cap to the recording means when said cap and the recording means are positioned apart.

4. An ink jet recording apparatus according to claim 1, wherein parting of said cap and the recording means is effected by movement of said cap.

5. An ink jet recording apparatus according to claim 1, wherein said recording means comprises an electrothermal converting element for generating thermal energy to be utilized for discharging ink.

6. An ink jet recording apparatus according to claim 5, wherein said recording means discharges ink from discharge ports by utilization of film boiling of the ink by the thermal energy generated by said electrothermal converting element.

* * * * *

UNITED STATES PATENT AND TRADEMARK OFFICE

CERTIFICATE OF CORRECTION

PATENT NO. : 7,014,291 B2
APPLICATION NO. : 10/354005
DATED : March 21, 2006
INVENTOR(S) : Tetsuya Ishikawa It is certified that error appears in the above-identified patent and that said Letters Patent is hereby corrected as shown below:

COLUMN 4:
Line 6, "vertically" should read --a vertically--.
Line 11, "vertically" should read --a vertically--.

COLUMN 8:
Line 17, "550" should read --55°--.

COLUMN 15:
Line 26, "as recording" should read --as a recording--.

Signed and Sealed this

Nineteenth Day of June, 2007

JON W. DUDAS
*Director of the United States Patent and Trademark Office*